US008328388B2

(12) United States Patent
Curran et al.

(10) Patent No.: US 8,328,388 B2
(45) **Date of Patent: *Dec. 11, 2012**

(54) SIGNAL LIGHT USING PHOSPHOR COATED LEDS

(75) Inventors: John Curran, Lebanon, NJ (US); John Patrick Peck, Manasquan, NJ (US)

(73) Assignee: Dialight Corporation, Farmingdale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/079,480

(22) Filed: Apr. 4, 2011

(65) Prior Publication Data

US 2011/0182070 A1 Jul. 28, 2011

Related U.S. Application Data

(63) Continuation of application No. 12/055,544, filed on Mar. 26, 2008, now Pat. No. 7,918,582, which is a continuation-in-part of application No. 11/618,552, filed on Dec. 29, 2006, now Pat. No. 7,777,322.

(60) Provisional application No. 60/755,704, filed on Dec. 30, 2005.

(51) Int. Cl.
*F21V 9/00* (2006.01)

(52) U.S. Cl. ..... 362/231; 362/84

(58) Field of Classification Search ..... 362/231, 362/84, 545

See application file for complete search history.

(56) References Cited

U.S. PATENT DOCUMENTS

| | | | | |
|---|---|---|---|---|
| 5,258,686 | A | 11/1993 | Segoshi et al. | |
| 6,509,651 | B1 | 1/2003 | Matsubara et al. | |
| 6,992,718 | B1 | 1/2006 | Takahara | |
| 7,408,201 | B2 | 8/2008 | Keuper et al. | |
| 7,602,057 | B2 * | 10/2009 | Curran et al. | 257/686 |
| 7,918,582 | B2 * | 4/2011 | Curran et al. | 362/231 |
| 2004/0124430 | A1 | 7/2004 | Yano et al. | |

* cited by examiner

*Primary Examiner* — Ali Alavi

(57) ABSTRACT

An improved signal light and method for making an improved signal light is disclosed. For example, the improved signal light includes a housing, at least one outer lens and at least one or more second type of light emitting diodes (LEDs) deployed in the housing. The at least one or more second type of LEDs includes a pump, a phosphor and a filter having a cutoff point less than or equal to 540 nanometers (nm). The at least one or more second type of LEDs also has a pump peak wavelength less than or equal to 430 nm and has a phosphor with a peak wavelength greater than 575 nm.

20 Claims, 6 Drawing Sheets

SIGNAL LIGHT USING PHOSPHOR COATED LEDS

RELATED APPLICATIONS

This application is a continuation of U.S. patent application Ser. No. 12/055,544, filed on Mar. 26, 2008, now U.S. Pat. No. 7,918,582, which was recently allowed, which is a continuation-in-part of U.S. patent application Ser. No. 11/618,552, filed on Dec. 29, 2006, now U.S. Pat. No. 7,777,322, entitled METHOD AND APPARATUS FOR PROVIDING A LIGHT SOURCE THAT COMPINES DIFFERENT COLOR LEDS, which claims priority under 35 U.S.C. §119 (e) to U.S. provisional patent application Ser. No. 60/755,704, filed on Dec. 30, 2005, where each of the above cited applications is hereby incorporated by reference in its entirety.

BACKGROUND OF THE INVENTION

1. Field of the Invention

The present invention generally relates to a light source, and more particularly to a light-emitting diode (LED) based signal lights. The present invention provides for a method of creating a more efficient signal light.

2. Description of the Related Art

Signal lights, such as yellow traffic lights or rail signals for example, provide visual indications. Previous yellow LED lights generally exhibit relatively poor energy efficiencies due to high degradation in light output at extreme temperatures, high or low. For example, traffic signal head temperatures can exceed 74 degrees Celsius (° C.) due to solar loading. The internal heating of each colored module of a traffic signal also contributes to the temperature rise.

Consequently, poor energy efficiencies may increase material costs, energy costs, and reduces the signal light life due to internal heating of electronic components. Reduced efficiencies may also limit the light intensity of the signal and create safety risks. Proper intensity levels are required, for example, on warm days with high solar loading as well as cooler days.

Therefore, there is a need in the art for an improved signal light, e.g. a traffic signal light, rail signal light and the like.

SUMMARY OF THE INVENTION

In one embodiment, the present invention provides a method for creating an improved traffic signal light. The improved traffic signal light may utilize LEDs of improved efficiency at high temperatures. The LEDs of improved efficiency may be used alone or may be combined with one or more other types of LEDs. For example, the signal light comprises a housing, at least one outer lens and at least one or more second type of light emitting diodes (LEDs) deployed in the housing. The at least one or more second type of LEDs includes a pump, a phosphor and a filter having a cutoff point less than or equal to 540 nanometers (nm). The at least one or more second type of LEDs also has a pump peak wavelength less than or equal to 430 nm and has a phosphor with a peak wavelength greater than 575 nm.

An exemplary method of creating the signal light comprises providing a housing, providing at least one outer lens and providing at least one or more second type of light emitting diodes (LEDs) deployed in the housing. The at least one or more second type of LEDs includes a pump, a phosphor and a filter having a cutoff point less than or equal to 540 nanometers (nm). The at least one or more second type of LEDs also has a pump peak wavelength less than or equal to 430 nm and has a phosphor with a peak wavelength greater than 575 nm.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

It is to be noted, however, that the appended drawings illustrate only exemplary embodiments of this invention and are therefore not to be considered limiting of its scope, for the invention may admit to other equally effective embodiments.

DETAILED DESCRIPTION

Figure 1:
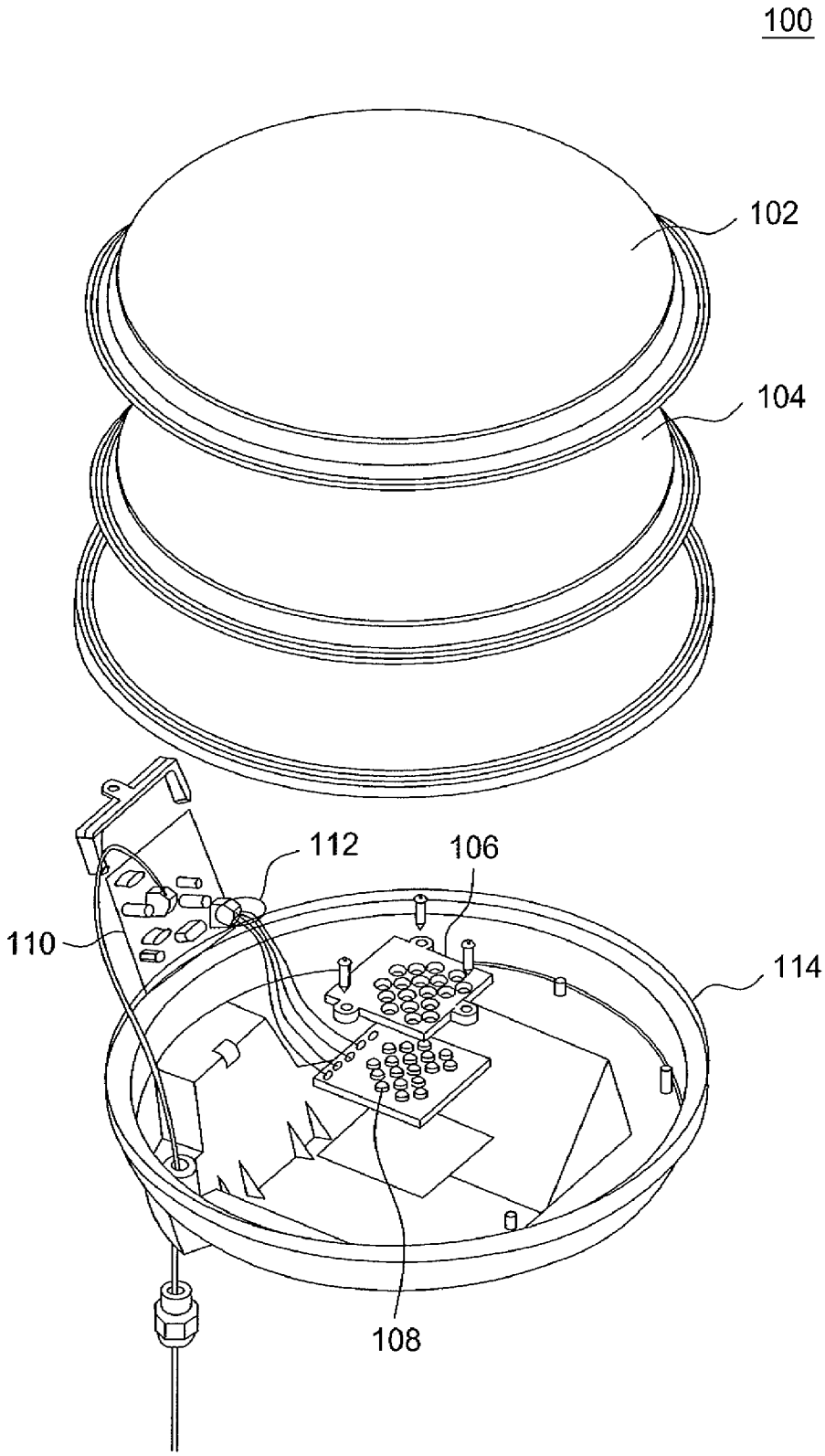
FIG. 1 illustrates an exploded view of an exemplary traffic signal light according to one embodiment of the present invention.
Figure 2:
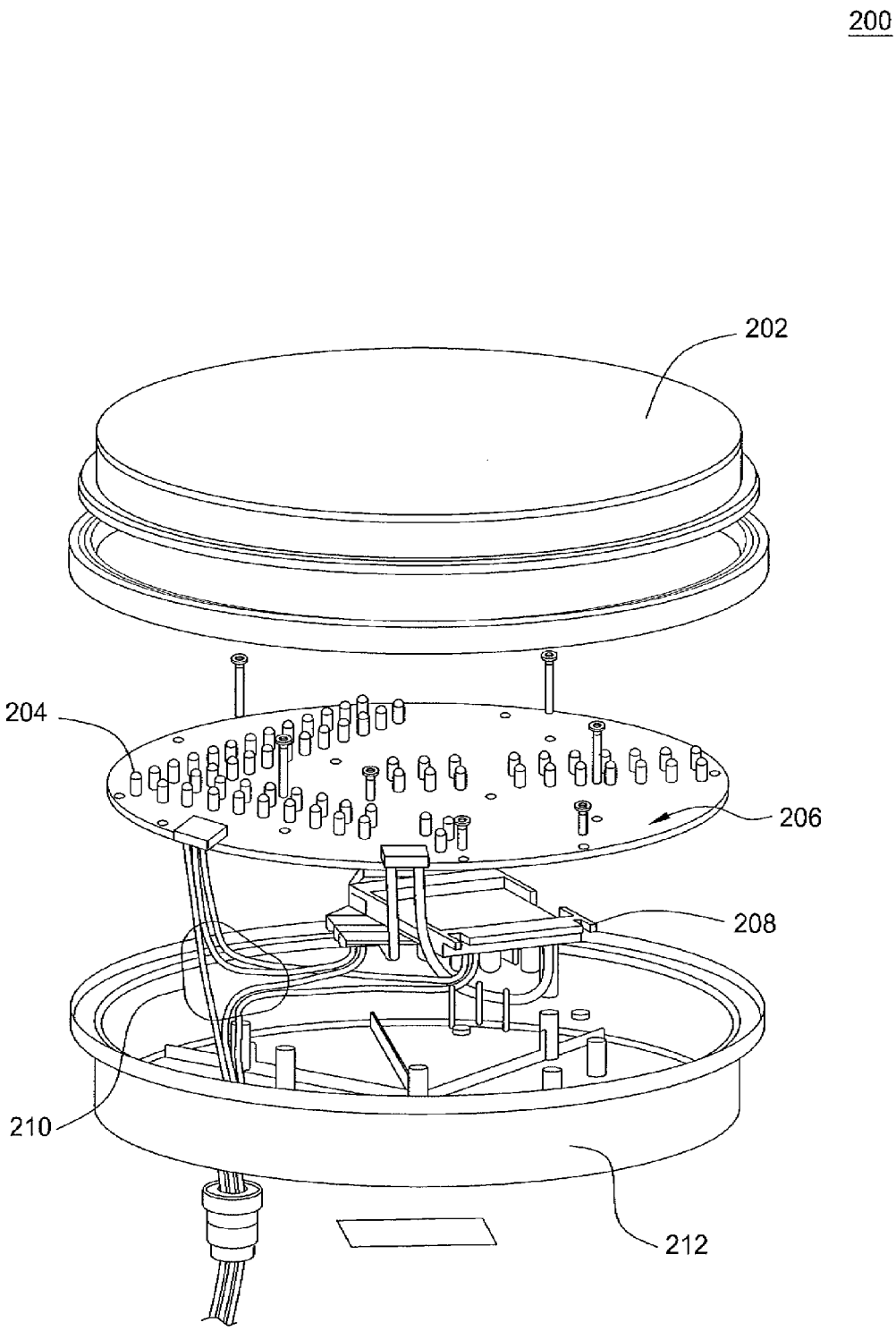
FIG. 2 illustrates an exploded view of another exemplary traffic signal light according to one embodiment of the present invention.

FIG. 1 illustrates an exploded view of an exemplary traffic signal light 100 according to one embodiment of the present invention. Traffic signal light 100 may comprise an outer lens 102, a mixing lens 104 such as, a Fresnel lens for example, and an array of light emitting diodes (LED) 108. In the exemplary embodiment depicted in FIG. 1, LEDs 108 may be high powered LEDs such as, for example, Hi-Flux LEDs. LEDs 108 may also be 5 millimeter (mm) discrete LEDs, as depicted in FIG. 2 and discussed below.

The outer lens 102 may be smooth or may have a scattered surface depending on if the outer lens 102 simultaneously serves as a filter (not shown) and/or serves as the mixing lens 104, as discussed below. The outer lens 102 may also comprise optical features to help diffract light into a desired angular direction.

LEDs 108 may be placed in a reflector 106. Reflector 106 may comprise individual reflector cups for each one of the LEDs 108. LEDs 108 may comprise one or more first type of LEDs and one or more second type of LEDs. The one or more first type of LEDs may emit a light energy having first dominant wavelength peak, for example a dominant wavelength peak of approximately 595 nanometers (nm) having an orange-yellow color. The one or more second type of LEDs may emit a light energy having a second dominant wavelength peak, for example a dominant wavelength peak of approximately 450 nm having a perceived white color via use of a blue LED coated with a yellow phosphor. Hereinafter, "white LEDs" refer to the perceived white color via use of a blue LED coated with a yellow phosphor, discussed above.

The phosphor material can have a significant effect on the color and efficiency of the LED. Some example phosphor materials include yttrium aluminum garnet (YAG), terbium aluminum garnet (TAG), and europium doped silicates. Phosphors can also be made by bonding the phosphor to a ceramic plate and mounting the plate over the LED die. This can provide better color consistency and therefore would be advantageous in the present invention. Although orange-yellow and white colored LEDs are used in exemplary embodiments of the present invention, one skilled in the art will recognize that any combination of color LEDs (e.g. a single color LED or different color LEDs) may be used within the scope of the present invention.

In one embodiment, the one or more second type of LEDs may be a blue LED using a yellow phosphor to convert most, if not all, of the blue light to yellow light. In another example, an ultraviolet (UV) LED is used with a phosphor to create a new color such as yellow. The blue or UV color is also known as the "pump" when used to excite a phosphor. In another embodiment a pump is used to create a green color. Hereinafter, "PC new" refers to the perceived phosphor converted new color via use of a pump LED coated with a phosphor. In some cases the PC new LED may be more efficient than the LEDs that created the color directly without the use of a phosphor conversion. In this case it may not be necessary to mix a first and second LED. Consequently, only the one or more second type of LEDs may be needed in the traffic signal light 100, as discussed below. In other words, none of the one or more first type of LEDs may be needed.

In an exemplary embodiment of the present invention, the one or more first type of LEDs and the one or more second type of LEDs may be placed adjacently in reflector 106 in an alternating fashion. In this case, the reflector 106 may serve to change LED light distribution. In one embodiment, the reflector helps concentrate the light into the lenses. This may also help mix the light by overlapping the light of the one or more first type of LEDs with the light of the one or more second type of LEDs. In another exemplary embodiment, the traffic signal light 100 may be comprised of only the one or more second type of LEDs. In some cases, the pump and the phosphor may not have exactly the same angular light intensity distribution. This can result in color variability on the lens. In this case, the reflector may facilitate better light mixing by changing the angular distribution of the pump light and the phosphor light. However, embodiments of the present invention are not limited to any particular arrangement and LEDs 108 may be placed in reflector 106 in any way.

Reflector 106 may be connected to a circuit board 110 via a plurality of wires 112. Circuit board 110 may include a processor for controlling the LEDs 108 on reflector 106. The reflector 106, the circuit board 110 and the plurality of wires 112 may be enclosed in a housing 114.

Traffic signal light 100 may also comprise a filter (not shown). The filter may be integrated into the outer lens 102, may be a separate lens located anywhere between the LEDs 108 and the outer lens 102 or may be placed directly over each of the LEDs 108. It may be desirable to place the filter directly over the LEDs in cases where it is preferable to use a non-tinted outer lens with little or no color. The filter may be a colored filter or a dichroic filter. Filtering may be performed in any method as is well known in the art of traffic signal light filtering.

In an exemplary embodiment, the filter may filter the one or more second type of LEDs emitting the light energy having the second dominant wavelength peak such that only a third dominant wavelength peak passes from the one or more second type of LEDs. For example, if the second type of LEDs are white colored LEDs, then the unfiltered white LEDs may have a dominant wavelength peak of approximately 450 nm. However, when filtered, the white LEDs may have a dominant wavelength peak of approximately 580 nm. In such an embodiment, the 580 nm dominant wavelength occurs because the filter blocks most of the 450 nm dominant wavelength, but transmits a portion of the phosphor emission originating from the phosphor coating with the new dominant wavelength. This is shown in FIG. 4.

Figure 6:
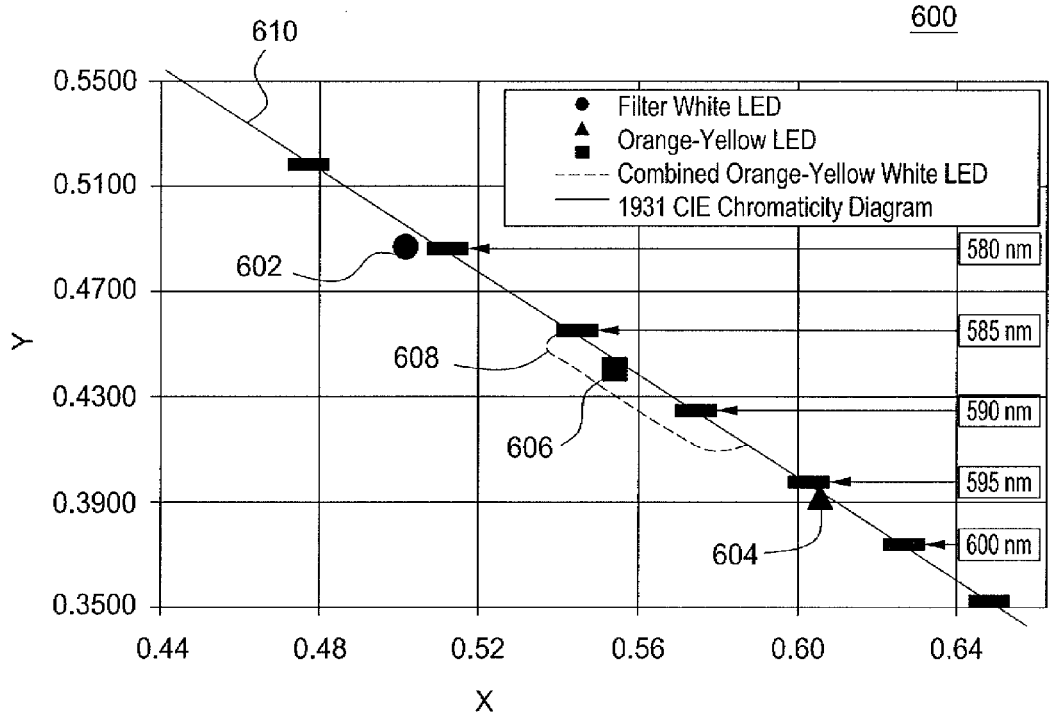
FIG. 6 illustrates exemplary coordinates of various LEDs.
Figure 8:
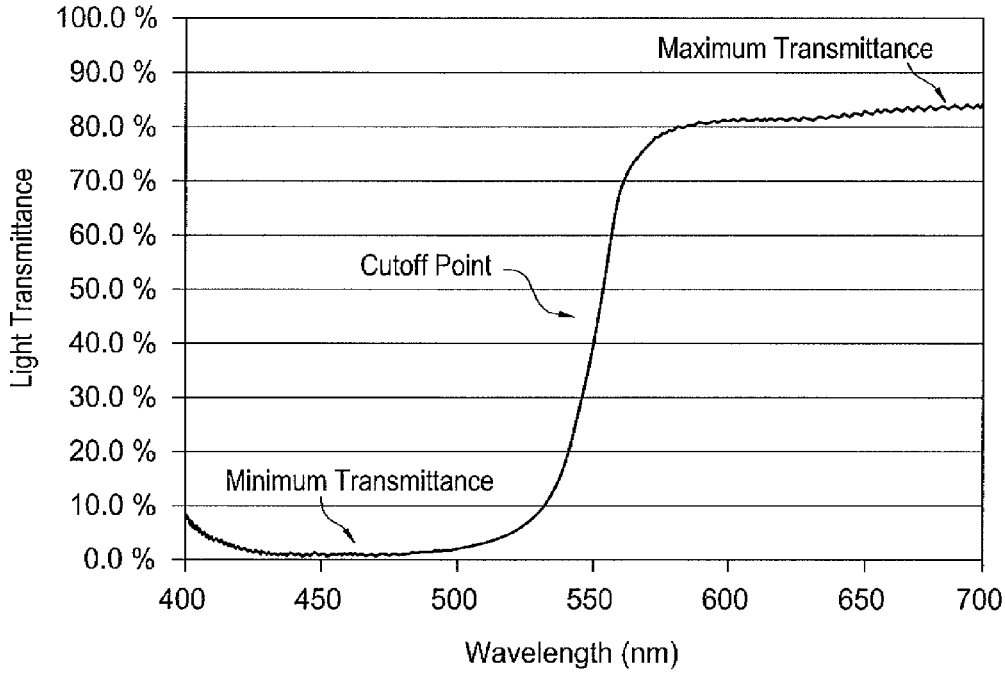
FIG. 8 illustrates a spectral transmittance of an exemplary filter that is currently used with yellow traffic signal lights.

In one example as illustrated by FIG. 6, the resulting 580 nm dominant wavelength 602 is not within an exemplary pre-defined range 608 that may represent desired chromaticity coordinates. A cutoff point can be used to describe the characteristics of the filter. The cutoff point is defined as the position in a visible spectrum at which a percent transmittance is midway between a maximum transmittance and a minimum transmittance. For example, FIG. 8 shows the spectral transmittance of an example filter that is currently used with yellow traffic lights. The maximum transmittance and the minimum transmittance are about 84% and 2%, respectively. A percent transmittance that is midway between the maximum transmittance and the minimum transmittance is 43% and, therefore, the cutoff point is located at about 545 nm.

Figure 4:
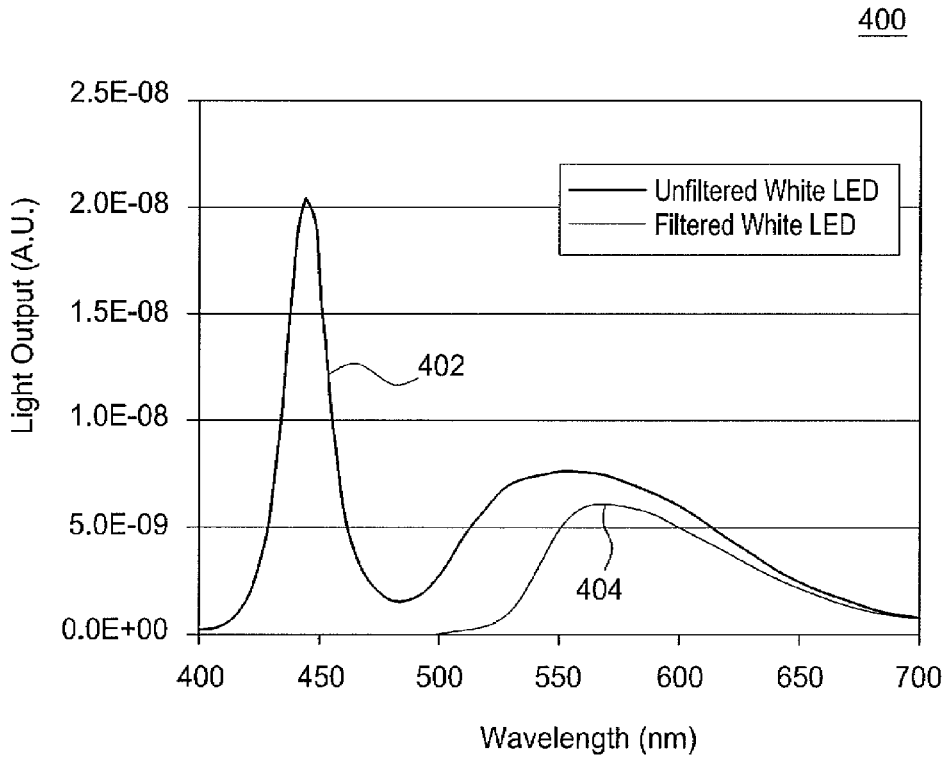
FIG. 4 illustrates a spectrum of an exemplary white LED before and after filtering.
Figure 9:
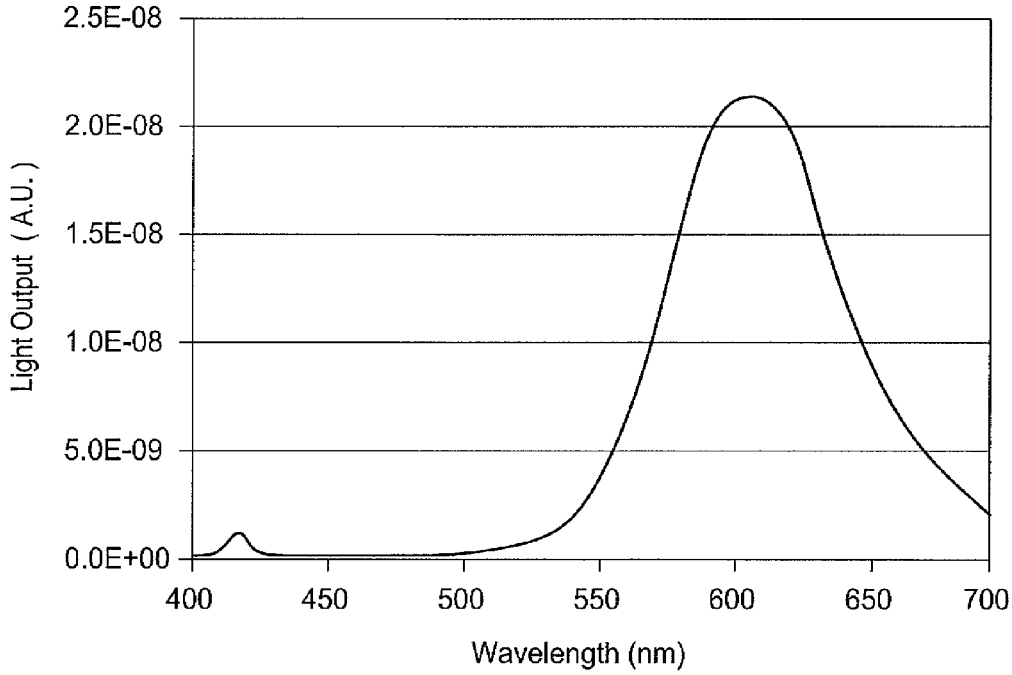
FIG. 9 illustrates an exemplary spectra of an LED light that has been converted by phosphor.

FIG. 4 shows that the spectral peak of an example phosphor is located around 550 nm. A more efficient signal light can be realized if a phosphor with a peak located at a longer wavelength is used. In this case less filtering would be required in the case where a longer dominant wavelength is desired. FIG. 9 shows an example spectra where most of the pump LED light, described above, has been converted by the phosphor. The pump color is of shorter wavelength than the LED shown in FIG. 4. A shorter pump wavelength can be more advantageous from an LED efficiency standpoint and is less visible to the human eye. The phosphor has a peak wavelength of about 600 nm and a dominant wavelength of about 590 nm. The longer peak wavelength may require less filtering in some applications where a more orange-yellow color is desired.

A cutoff point for the filter may be calculated by determining what dominant wavelength peak is desired without sacrificing efficacy (lumens/watt). For example, filtering white LEDs may not provide any better efficacy than the yellow AlInGaP LEDs currently used in traffic signal lights. To resolve this problem, the cutoff point of the filter may be increased or decreased in order to change the resulting dominant wavelength. In one embodiment, the cutoff point is set to approximately 550 nm+/−40 nm such that more light may be transmitted and the efficacy may be improved. As mentioned earlier, it may not be necessary to mix the one or more first type of LED and the one or more second type of LED. Only the one or more second type of LED may be used if the one or more second type of LED is a PC new LED that is highly efficient. In this case, the cutoff point can be critical and can be chosen in order to block a portion of the pump LED light and transmit a portion of the phosphor light generated from the phosphor emission in a manner that results in a final dominant wavelength with chromaticity coordinates within a desired boundary. As stated earlier, better color consistency can be achieved by using a phosphor that is bonded to a ceramic plate and attached to the LED die. In one embodiment, a filter with a cutoff point is used with a ceramic plate bonded phosphor LED in order to achieve even better color consistency. In one embodiment, the pump peak wavelength is less than or equal to 430 nm for the one or more second type of LED, e.g., the PC new LED. In one embodiment, the phosphor peak wavelength is greater than 575 nm for the one or more second type of LED, e.g., the PC new LED. In one embodiment, the cutoff point is less than or equal to 540 nm. This may provide a yellow color when used with a phosphor LED. In another embodiment, the cutoff point is less than or equal to 550 nm and may provide a more orange-yellow color when used with a phosphor LED. In a further embodiment, the cutoff point is less than or equal to 520 nm and may provide a more green-yellow color when used with a phosphor LED. In an even further embodiment, the cutoff point is greater than or equal to 590 nm and may provide a more orange or red color when used with a phosphor LED. In one embodiment, the filter passes at least 70% of the light at about 600 nm. In one embodiment, the filter passes not more than 30% of the light at about 425 nm. One skilled in the art will recognize that the cutoff point can also be raised, lowered or modified to achieve a desired dominant wavelength peak or chromaticity coordinates. In one embodiment, the dominant wavelength of the non-filtered PC new LED is between 580 nm and 595 nm. In one embodiment, the range of chromaticity coordinates for the light energy exiting the signal may be as shown below by Table 3.

However, when using two different LEDs (e.g. the one or more first type of LEDs and the one or more second type of LEDS) the filtered white LED may have a dominant wavelength peak of approximately 580 nm resulting in a green-yellow color. To resolve this problem, the mixing lens 104 may be used to mix two light energies having different dominant wavelength peaks to achieve a light energy having a desired dominant wavelength peak, as discussed below.

Referring to the mixing lens 104, in an exemplary embodiment mixing lens 104 may be integrated into the outer lens 102 that also functions as the filter, as discussed above. In such an exemplary embodiment, outer lens 102 may comprise a scattered surface to mix the light energies of the first and second type of LEDs. In an alternate embodiment, the mixing lens 104 may be a separate lens such as, for example, a Fresnel lens.

Alternatively, mixing of the light energies emitted from the one or more first and second type of LEDs may occur without a physical device such as mixing lens 104. For example, mixing of the light energies emitted from the one or more first and second type of LEDs may be done by proper positioning of the one or more first and second type of LEDs. As such, one skilled in the art will recognize that any mechanism for overlapping or mixing light energies emitted from the one or more first and second type of LEDs may be used such as, for example, using a physical device or structure or using proper positioning of the one or more first and second type of LEDs.

The mixing lens 104 may combine the light energy having the first dominant wavelength peak emitted from the first type of LEDs and the light energy having the third dominant wavelength peak emitted from the filtered second type of LEDs to produce a light energy having a desired fourth dominant wavelength peak. For example, the fourth dominant wavelength peak may be desired because it falls within a pre-defined range, as discussed below. Alternatively, if the fourth dominant wavelength may be achieved using only the one or more second type of LEDs, then only the one or more second type of LEDs may be used. Consequently, the mixing lens 104 may serve to mix the spectral light only from the one or more second type of LEDs.

In an exemplary embodiment, the first type of LEDs may be made of aluminum indium gallium phosphide (AlInGaP) and the second type of LEDs may be made of indium gallium nitride (InGaN). Moreover, in an embodiment where only the one or more second type of LEDs are used, the one or more second type of InGaN LEDs may be the PC new LEDs described above. However, LEDs 108 may be any combination of LEDs made of any type of materials typically used to construct LEDs.

FIG. 2 illustrates an exploded view of another exemplary signal light, e.g. a traffic signal light 200 according to one embodiment of the present invention. Traffic signal light 200 may be a traffic signal light utilizing 5 mm discrete LEDs 204. Traffic signal light 200 may comprise an outer lens 202, a reflector 206 for holding LEDs 204. Moreover, reflector 206 may be connected to a circuit board 208 via a plurality of wires 210. Similar to circuit board 110 discussed above, circuit board 208 may also include a processor for controlling LEDs 204. Reflector 206, circuit board 208 and the plurality of wires 210 may be enclosed in a housing 212.

Similar to LEDs 108 of traffic signal light 100 discussed above, LEDs 204 of traffic signal light 200 may also comprise one or more first type of LEDs and one or more second type of LEDs. Alternatively, the traffic signal light 200 may contain only one or more of the second type of LEDs. The one or more first type of LEDs may emit a light energy having a first dominant wavelength peak and the one or more second type of LEDs may emit a light energy having a second dominant wavelength peak. In an exemplary embodiment of the present invention, the one or more first type of LEDs and the one or more second type of LEDs may be placed adjacently in reflector 206 in an alternating fashion. However, embodiments of the present invention are not limited to such an arrangement and LEDs 204 may be placed in reflector 206 in any way.

Moreover, one skilled in the art will recognize that traffic signal light 200 may be similar to traffic signal light 100 in all other respects except the type of LED that is used, e.g. Hi-Flux LEDs or 5 mm discrete LEDs. For example, although FIG. 2 does not illustrate a mixing lens 104, one skilled in the art will recognize that a mixing lens 104 may be added to traffic signal light 200, similar to traffic signal 100, in any configuration discussed above. Analogously, a filter may be included in traffic signal light 200 in any configuration similar to traffic signal light 100, as discussed above.

Consequently, the exemplary embodiment of the signal light illustrated in FIG. 1 and FIG. 2 may be more efficient than traffic signal lights currently used in the art. For example, a traffic signal light may comprise a red signal, a yellow signal and a green signal. Currently, yellow signal lights may be constructed with all yellow colored LEDs made from AlInGaP. However, traditional yellow LEDs made from AlInGaP suffer from light degradation at increased temperatures, as illustrated in FIG. 3.

Alternatively, if a yellow LED is made with InGaN technology it would provide a large performance improvement if used in the traffic signal light for yellow traffic signals. As a result, a yellow InGaN LED may be used for embodiments described above where only the one or more second type of LEDs are used in traffic signal light 100 and 200. An example of such an InGaN LED able to achieve the desired yellow color is a PC new LED described above.

Figure 3:
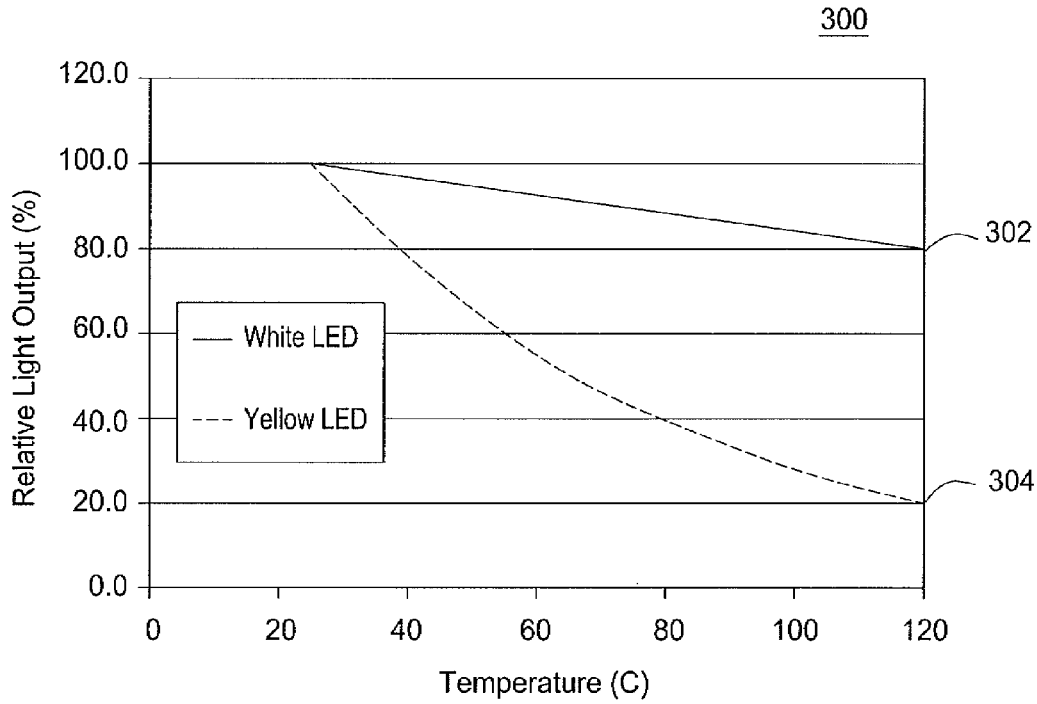
FIG. 3 illustrates a graph of exemplary light degradation of various LEDs.

FIG. 3 illustrates a graph 300 of exemplary light degradation of various LEDs. As discussed above, traffic lights may be exposed to high temperatures due to solar loading. Traditional yellow LEDs made from AlInGaP suffer from a rapid rate of light degradation as the temperature increases, as illustrated by line 304 of graph 300. As discussed above, traffic signal head temperatures can exceed 74° C. due to solar loading, internal heat and other factors. As shown by graph 300, at 74° C., a yellow LED made from AlInGaP may lose approximately 50% of its light output. In other words, at 74°

C. a traffic signal head for yellow signal lights would require twice as many LEDs than would normally be required at room temperature.

However, LEDs made from InGaN have a higher efficiency than LEDs made from AlInGaP as temperatures increase. In other words, LEDs made from InGaN, such as white colored LEDs for example, have less light degradation as the temperature increases, as illustrated by line 302 in graph 300. As shown by graph 300, at 74° C. a white LED made from InGaN may lose only approximately 10% of its light output.

However, in an exemplary embodiment of the present invention, to use white colored LEDs made from InGaN, the white colored LEDs may be filtered such that only yellow colored light passes. However, the yellow colored light emitted from the filtered white LED may still be outside a pre-defined range. For example, the pre-defined range may be the wavelength requirements for traffic signals as defined by a regulatory agency or by a particular city. For example, some cities may require that a yellow signal light have a dominant wavelength peak of approximately 590 nm. However, the yellow light emitted from the filtered white LEDs may have a dominate wavelength peak of approximately 580 nm.

FIG. 4 illustrates a graph 400 depicting a spectrum of an exemplary white LED before and after filtering. For example, an unfiltered white LED may have a dominate wavelength peak of approximately 450 nm as depicted by line 402 of graph 400. A filtered white LED may have a dominate wavelength peak of approximately 580 nm as depicted by line 404 of graph 400.

Figure 5:
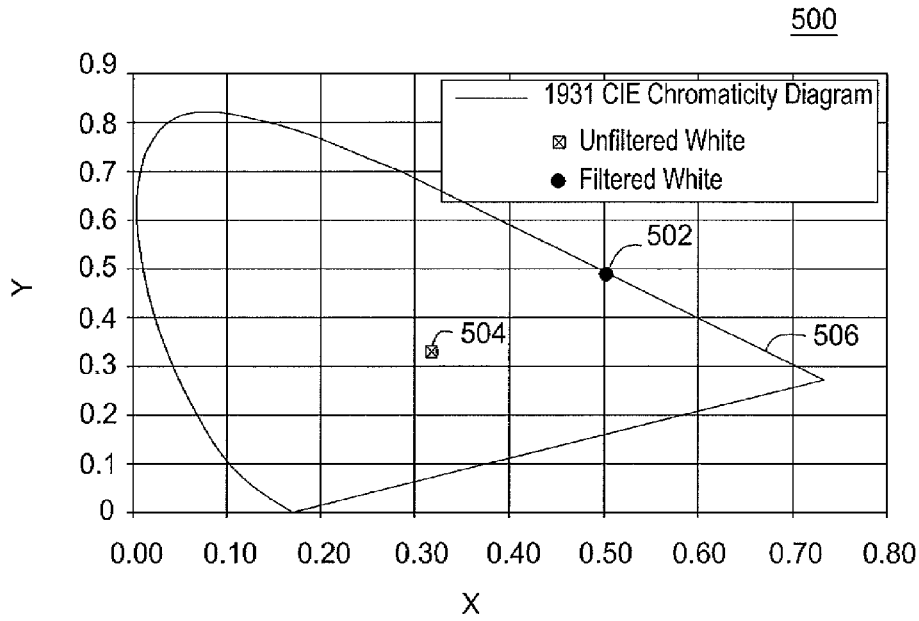
FIG. 5 illustrates exemplary coordinates of filtered and unfiltered white LEDs.

The color of the emitted light energy from an unfiltered and filtered LED may also be described in terms of coordinates of a chromaticity diagram, as illustrated in FIG. 5 for example. FIG. 5 illustrates a graph 500 depicting exemplary coordinates of filtered and unfiltered white LEDs. The coordinates are mapped on a 1931 CIE Chromaticity Diagram. Mark 504 of graph 500 illustrates approximate coordinates of an unfiltered white LED. Mark 502 of graph 500 illustrates approximate coordinates of a filtered white LED.

However, as noted above, using the filtered white LED made from InGaN may still emit light having a dominate wavelength peak that is outside of a pre-defined range. To create a light energy having a desired dominate wavelength peak, the light energy of the filtered white LED may be mixed with a light energy of another LED, as described above. For example, the other LED may be an orange-yellow LED having a dominate wavelength peak of approximately 595 nm. Although an orange-yellow LED and white LED are used in an exemplary embodiment of the present invention, one skilled in the art will recognize that any combination of colored LEDs may be used within the scope of the present invention. The color combination of the LEDs may be determined by a final desired color. For example, a different color combination of LEDs may be used to achieve a red signal light.

By mixing the filtered white LED light energy with the light energy of the orange-yellow LED, a light energy may be created having a desired dominate wavelength peak within the pre-defined range, e.g. approximately 590 nm. An example of this is illustrated in FIG. 6. Alternatively, as described above, only the one or more second type of LEDs may be necessary if the one or more second type of LEDs are PC new LEDs, described above. In this case, only the spectral energy of the PC new LEDs is mixed.

FIG. 6 illustrates a graph 600 depicting exemplary coordinates of various LEDs on a chromaticity diagram. For example, graph 600 illustrates exemplary coordinates of a light energy of a filtered white LED, a light energy of an orange-yellow LED and a light energy created from mixing the light energy of the filtered white LED and the light energy of the orange-yellow LED. The exemplary coordinates are plotted against a close up of the 1931 CIE Chromaticity Diagram depicted by line 610 of graph 600. In addition, an exemplary pre-defined range, for example the required range for yellow traffic signals, is depicted by dashed line 608.

As discussed above, the light energy of a filtered white LED may have a dominant wavelength peak of approximately 580 nm, illustrated by mark 602. An exemplary range of chromaticity coordinates for a filtered white LED may be as shown below by Table 1.

TABLE 1

| x | y |
|---|---|
| 0.4 | 0.6 |
| 0.4 | 0.5 |
| 0.5 | 0.4 |
| 0.55 | 0.45 |
| 0.4 | 0.6 |

Exemplary Range of Chromaticity Coordinates for a Filtered White LED.

Although the filtered white LED may have a yellow color, the yellow color of the filtered white LED may still be outside the pre-defined range. For example, mark 602 is outside of the dashed line 608 representing the pre-defined range. However, a light energy from another LED, for example a light energy from an orange-yellow LED, may be mixed with the light energy from the filtered white LED. For example, the light energy from the orange-yellow LED may have a dominant wavelength peak of approximately 595 nm, illustrated by mark 604. An exemplary range of chromaticity coordinates for an orange-yellow LED may be as shown below by Table 2.

TABLE 2

| x | y |
|---|---|
| 0.5 | 0.4 |
| 0.5 | 0.5 |
| 0.65 | 0.35 |
| 0.6 | 0.3 |
| 0.5 | 0.4 |

Exemplary Range of Chromaticity Coordinates for an Orange-Yellow LED.

Mixing the light energy from the orange-yellow LED with the light energy from the filtered white LED may create a new light energy having a dominate wavelength peak of approximately 590 nm, as illustrated by mark 606. Alternatively, as discussed above, the dominate wavelength peak of approximately 590 nm, as illustrated by mark 606, may be achieved by using only the one or more second type of LEDs, e.g., the PC new LED described herein. The new light energy may have a dominate wavelength peak that falls within the pre-defined range. This is illustrated by mark 606 being within dashed-line 608 representing the pre-defined range. This range is shown in Table 3a. An exemplary range of chromaticity coordinates for the new light energy may be as shown below by Table 3b.

TABLE 3a

| x | y |
|---|---|
| 0.55 | 0.45 |
| 0.54 | 0.45 |
| 0.58 | 0.41 |
| 0.59 | 0.41 |
| 0.55 | 0.45 |

TABLE 3b

| x | y |
|---|---|
| 0.53 | 0.47 |
| 0.51 | 0.47 |
| 0.59 | 0.39 |
| 0.61 | 0.39 |
| 0.53 | 0.47 |

Exemplary Range of Chromaticity Coordinates for an Orange-Yellow LED.

As a result, the exemplary embodiment of the signal light illustrated in FIG. 1 and FIG. 2 may be more efficient than traffic signal lights currently used in the art. For example, the traffic signal lights illustrated in FIG. 1 and FIG. 2 may have less light degradation and have a longer life due to the use of LEDs made from InGaN. Moreover, the combined use of AlInGaP LEDs and InGaN LEDs may still be combined to create a light energy having a dominate wavelength peak within a pre-defined range, for example a required range for yellow traffic lights.

Figure 7:
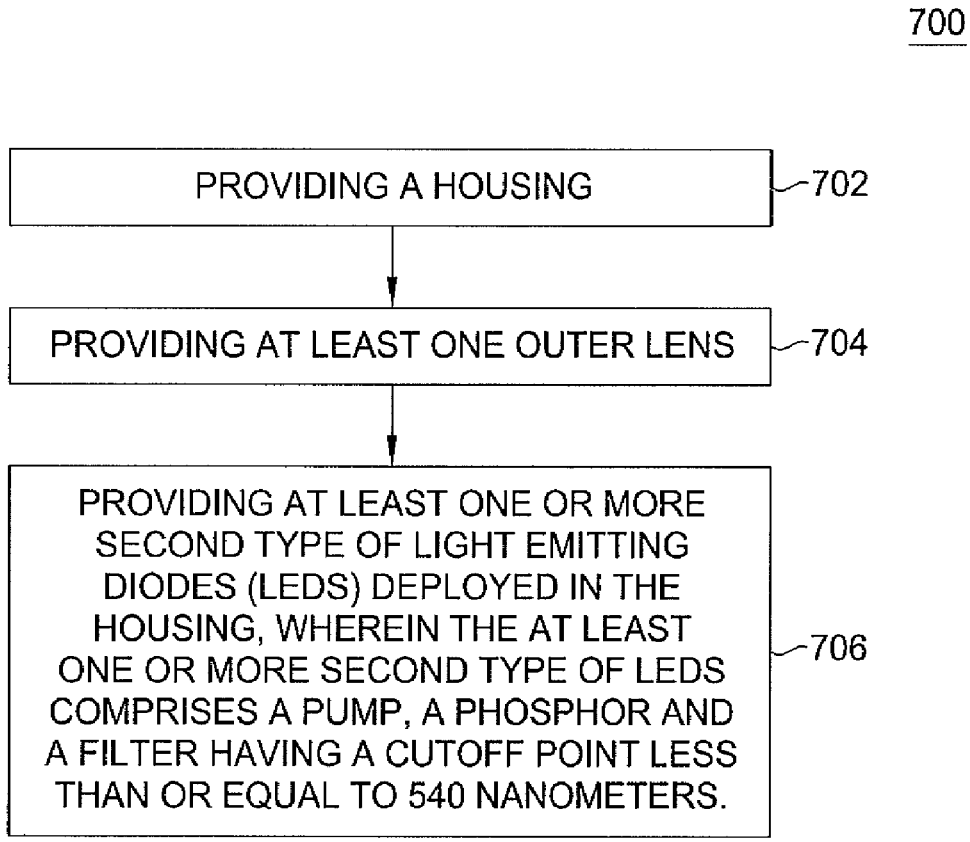
FIG. 7 illustrates a flow chart of an exemplary method of creating an improved traffic signal light as described herein.

FIG. 7 illustrates a flow chart of an exemplary method 700 of creating an improved traffic signal light as described herein. Method 700 begins at step 702 where a housing is provided.

At step 704, method 700 may provides at least one outer lens.

At step 706, method 700 provides one or more second type of light emitting diodes (LEDs) deployed in the housing, wherein the at least one or more second type of LEDs comprises a pump, a phosphor and a filter having a cutoff point less than or equal to 540 nanometers (nm). The at least one or more second type of LEDs has a pump peak wavelength less than or equal to 430 nm and has a phosphor with a peak wavelength greater than 575 nm.

In one embodiment the one or more second type of LEDs may be made of indium gallium nitride (InGaN). Moreover, in another embodiment the one or more second type of InGaN LEDs may be PC new LEDs described above. Method 700 concludes after step 706.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

The invention claimed is:

1. A light emitting diode (LED) signal light comprising:

one or more LEDs, wherein the one or more LEDs comprises:

a pump;

a phosphor; and a filter having a cutoff point less than or equal to 540 nanometers (nm), wherein the one or more LEDs has a pump peak wavelength less than or equal to 430 nm and have a phosphor with a peak wavelength greater than 575 nm.

2. The LED signal light of claim 1, wherein the filter passes at least 70% of a light emitted from the one or more LEDs at about 600 nm.

3. The LED signal light of claim 1, wherein a light exiting the LED signal light has x and y coordinates in accordance with a 1931 CIE Chromaticity Diagram within the boundaries of:

| x | y |
|---|---|
| 0.53 | 0.47 |
| 0.51 | 0.47 |
| 0.59 | 0.39 |
| 0.61 | 0.39 |
| 0.53 | 0.47. |

4. The LED signal light of claim 1, wherein a light exiting the LED signal light has x and y coordinates in accordance with a 1931 CIE Chromaticity Diagram within the boundaries of:

| x | y |
|---|---|
| 0.55 | 0.45 |
| 0.54 | 0.45 |
| 0.58 | 0.41 |
| 0.59 | 0.41 |
| 0.55 | 0.45. |

5. The LED signal light of claim 1, wherein the one or more LEDs are made of Indium Gallium Nitride (InGaN).

6. The LED signal light of claim 1, wherein the phosphor is embedded in a ceramic plate and mounted over a LED die.

7. The LED signal light of claim 1, wherein the phosphor is bonded to a ceramic plate and mounted over a LED die.

8. The LED signal light of claim 1, wherein the phosphor includes yttrium aluminum garnet (YAG).

9. The LED signal light of claim 1, wherein the phosphor includes terbium aluminum garnet (TAG).

10. The LED signal light of claim 1, wherein the phosphor includes europium doped silicates.

11. The LED signal light of claim 1, wherein the one or more LEDs are placed in a reflector.

12. The LED signal light of claim 11, wherein the reflector is enclosed by a housing and an outer lens.

13. The LED signal light of claim 1, wherein a Fresnel lens is placed between the one or more LEDs and a housing.

14. The LED signal light of claim 1, wherein a second filter is used, wherein said second filter filters a light energy of the one or more LEDs such that a third dominant wavelength passes from the one or more LEDs.

15. The LED signal light of claim 1, wherein the filter comprises a colored or dichroic filter.

16. A method of creating a light emitting diode (LED) signal light, comprising:

providing one or more LEDs, wherein the one or more LEDs comprises:

a pump;

a phosphor; and a filter having a cutoff point less than or equal to 540 nanometers (nm), wherein the one or more LEDs have a pump peak wavelength less than or equal to 430 nm and have a phosphor with a peak wavelength greater than 575 nm.

17. The method of claim 16, wherein the filter passes at least 70% of a light emitted from the one or more LEDs at about 600 nm.

18. The method of claim 16, wherein the one or more LEDs are placed in a reflector.

19. The method of claim 16, wherein the phosphor is embedded in a ceramic plate and mounted over a LED die.

20. The method of claim 16, wherein the phosphor is bonded to a ceramic plate and mounted over a LED die.

* * * * *